US007690945B2

(12) United States Patent
Petersen

(10) Patent No.: US 7,690,945 B2
(45) Date of Patent: Apr. 6, 2010

(54) COAXIAL CABLE CONNECTOR FOR CORRUGATED CABLE

(75) Inventor: Jens Petersen, Vordingborg (DK)

(73) Assignee: Corning Gilbert Inc., Glendale, AZ (US)

( * ) Notice: Subject to any disclaimer, the term of this patent is extended or adjusted under 35 U.S.C. 154(b) by 0 days.

(21) Appl. No.: 12/265,286

(22) Filed: Nov. 5, 2008

(65) Prior Publication Data

US 2009/0130900 A1 May 21, 2009

Related U.S. Application Data

(60) Provisional application No. 61/004,011, filed on Nov. 21, 2007.

(51) Int. Cl.
*H01R 9/05* (2006.01)

(52) U.S. Cl. ..... 439/584

(58) Field of Classification Search ..... 439/584, 439/578, 583
See application file for complete search history.

(56) References Cited

U.S. PATENT DOCUMENTS

| | | | | |
|---|---|---|---|---|
| 3,199,061 | A | 8/1965 | Johnson, et al. | 339/100 |
| 3,291,895 | A | 12/1966 | Van Dyke | 174/88 |
| 4,046,451 | A | 9/1977 | Juds et al. | 339/177 |
| 5,137,470 | A | 8/1992 | Doles | 439/578 |
| 5,154,636 | A | 10/1992 | Vaccaro et al. | 439/583 |
| 5,167,533 | A | 12/1992 | Rauwolf | 439/583 |
| 5,435,745 | A | 7/1995 | Booth | 439/584 |
| 6,109,964 | A | 8/2000 | Kooiman | 439/583 |
| 6,217,384 | B1 | 4/2001 | Strasser et al. | 439/583 |
| 6,267,621 | B1 | 7/2001 | Pitschi et al. | 439/584 |
| 6,332,808 | B1 * | 12/2001 | Kanda et al. | 439/584 |
| 6,802,738 | B1 | 10/2004 | Henningsen | 439/583 |
| 6,824,415 | B2 | 11/2004 | Wlos | 439/348 |
| 6,840,803 | B2 | 1/2005 | Wlos et al. | 439/585 |
| 6,893,290 | B2 | 5/2005 | Buenz et al. | 439/578 |
| 6,994,587 | B2 | 2/2006 | Buenz et al. | 439/578 |
| 7,134,189 | B2 | 11/2006 | Buenz et al. | 29/748 |
| 7,189,114 | B1 | 3/2007 | Burris et al. | 439/578 |
| 7,217,154 | B2 | 5/2007 | Harwath | 439/578 |
| 7,249,969 | B2 | 7/2007 | Paynter | 439/578 |
| 7,275,957 | B1 | 10/2007 | Wlos et al. | 439/583 |

FOREIGN PATENT DOCUMENTS

| | | |
|---|---|---|
| DE | 3422549 A1 | 12/1985 |
| DE | 4207482 | 3/1992 |
| DE | 9400943 U1 | 4/1994 |
| EP | 0901200 | 3/1999 |
| EP | 1122835 A1 | 2/2000 |
| EP | 1148592 A1 | 4/2000 |
| EP | 1170833 A1 | 7/2000 |
| EP | 1376773 A2 | 1/2004 |
| EP | 1011175 | 1/2005 |
| FR | 2682819 | 10/1991 |
| GB | 2277207 | 10/1994 |

* cited by examiner

*Primary Examiner*—Phuong K Dinh
(74) *Attorney, Agent, or Firm*—Matthew J. Mason

(57) ABSTRACT

A coaxial cable connector is provided for attachment to a corrugated coaxial cable. The coaxial cable connector includes a clamping member with at least two projections configured to engage the outer corrugated conductor where the corrugated conductor has a diameter that is the smallest. The coaxial cable connector also includes seals to protect the coaxial cable connector from the elements. An alternative embodiment includes a third projection to engage the outer corrugated conductor to provide support for the coaxial cable.

11 Claims, 6 Drawing Sheets

COAXIAL CABLE CONNECTOR FOR CORRUGATED CABLE

CROSS-REFERENCE TO RELATED APPLICATIONS

This application claims the benefit of, and priority to U.S. Provisional Patent Application No. 61/004,011 filed on Nov. 21, 2007, the content of which is relied upon and incorporated herein by reference in its entirety.

BACKGROUND OF THE INVENTION

1. Field of the Invention

The present invention relates to connectors for coaxial cables and, more particularly, to connectors for coaxial cables which have annularly corrugated outer conductors.

2. Technical Background

A coaxial cable is characterized by having an inner electrical conductor, an outer electrical conductor, and an insulator between the inner and outer electrical conductors. The inner electrical conductor may be hollow or solid. At the end of coaxial cable, a connector is attached to allow for mechanical and electrical coupling of the coaxial cable.

Connectors for coaxial cables have been used throughout the coaxial cable industry for a number of years. One type of coaxial cable has an annularly corrugated outer conductors and plain cylindrical inner conductors. Generally, connectors for these coaxial cables are different from those where the outer electrical conductors are smooth or uncorrugated. As an example, one connector has a single annular clamping portion that meshes with the last valley in the corrugated outer conductor providing a single circumferential point of contact. Without additional axial reinforcement from the coaxial cable connector, physical gyrations of the cable found in field applications due to weather and vibration can cause undue stress and, ultimately, material fatigue of the corrugated cable outer conductor.

Therefore, there is a continuing need for improved high performance coaxial cable connectors that are easy and fast to install and un-install, particularly under field conditions. Also, since these connectors are generally installed in the field, they should be pre-assembled into one piece connectors, so that the possibility of dropping and losing small parts, misplacing O-rings, damaging or improperly lubricating O-rings, or other assembly errors in the field is minimized. Additionally, it should be possible for the coaxial cable connector to be installed and removed without the use of any special tools.

SUMMARY OF THE INVENTION

Disclosed herein is a coaxial cable connector for attachment to a coaxial cable, the coaxial cable comprising a center conductor, a dielectric layer surrounding the center conductor, and an outer corrugated conductor surrounding the dielectric layer, the coaxial cable connector includes a rear outer body having a front end, a back end, an external gripping portion, and a longitudinal opening extending between the front end and the back end along a longitudinal axis, a clamping member rotatably mounted within the longitudinal opening in the rear outer body from the front end thereof, the clamping member having an internal surface with at least two projections configured to engage the outer corrugated conductor where the corrugated conductor has a diameter that is the smallest, a front body having a front end, a back end, an external gripping portion, and a longitudinal opening extending between the front end and the back end along a longitudinal axis, an insulator disposed in the front body, the insulator having an opening therein coaxial with the longitudinal axis of the front body, a contact element disposed in the opening of the insulator, the contact element having a back end configured to engage the center conductor of the corrugated coaxial cable.

In another aspect, a combination of a corrugated coaxial cable and a coaxial connector is disclosed, the coaxial cable comprising a center conductor, a dielectric layer surrounding the center conductor, an outer corrugated conductor surrounding the dielectric layer, and a jacket surrounding the outer corrugated conductor, the coaxial cable connector includes a rear outer body having a front end, a back end, an external gripping portion, and a longitudinal opening extending between the front end and the back end along a longitudinal axis, a clamping member rotatably mounted within the longitudinal opening in the rear outer body from the front end thereof, the clamping member having an internal surface with at least two projections engaging the outer corrugated conductor where the corrugated conductor has a diameter that is the smallest, a front body having a front end, a back end, an external gripping portion, and a longitudinal opening extending between the front end and the back end along a longitudinal axis, an insulator disposed in the front body, the insulator having an opening therein coaxial with the longitudinal axis of the front body, and a contact element disposed in the opening of the insulator, the contact element having a back end engaging at least a portion of the center conductor of the corrugated coaxial cable.

Additional features and advantages of the invention will be set forth in the detailed description which follows and, in part, will be readily apparent to those skilled in the art from that description or recognized by practicing the invention as described herein, including the detailed description which follows, the claims, and the appended drawings.

It is to be understood that both the foregoing general description and the following detailed description of the present embodiments of the invention are exemplary and explanatory, and are intended to provide an overview or framework for understanding the nature and character of the invention as it is claimed. The accompanying drawings are included to provide a further understanding of the invention and are incorporated into and constitute a part of this specification. The drawings illustrate various embodiments of the invention and, together with the description, serve to explain the principles and operations of the invention.

DETAILED DESCRIPTION OF THE PREFERRED EMBODIMENTS

Figure 1:
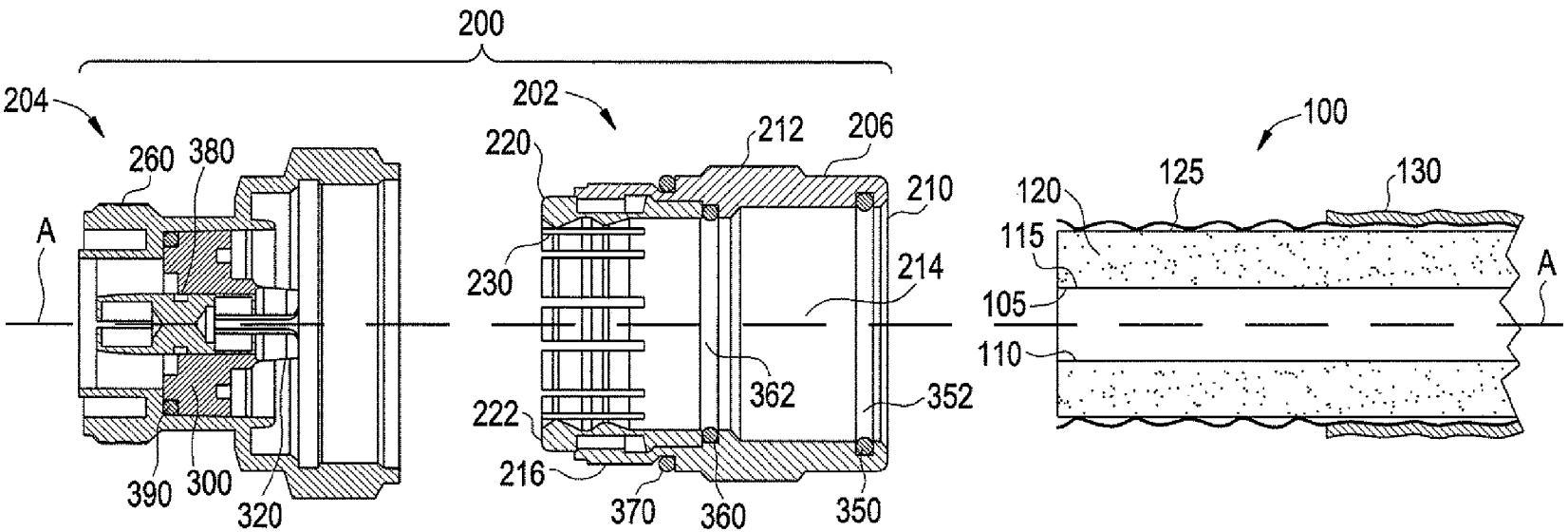
FIG. 1 is cross-sectional view of one embodiment of a partially assembled coaxial cable connector according to the present invention and a portion of a corrugated coaxial cable.

Reference will now be made in detail to the present preferred embodiment(s) of the invention, examples of which are illustrated in the accompanying drawings. Whenever possible, the same reference numerals will be used throughout the drawings to refer to the same or like parts.

Figure 2:
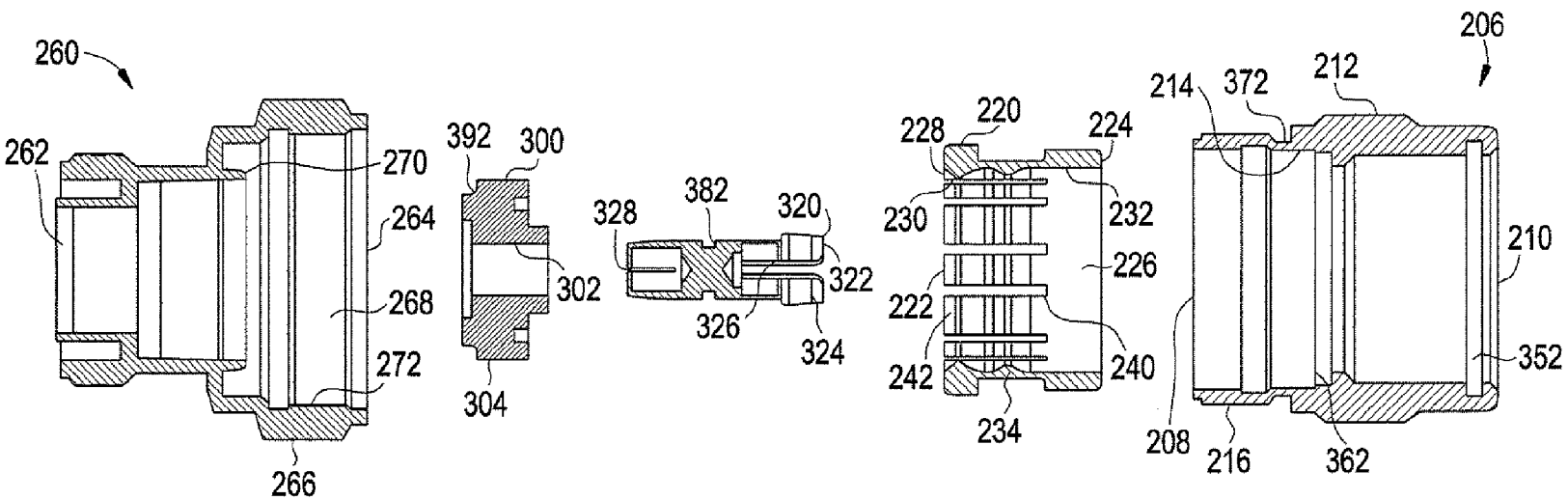
FIG. 2 is an exploded, cross-sectional view of the coaxial cable of FIG. 1.

Referring to FIGS. 1 & 2, a cross sectional view of a portion of a corrugated coaxial cable 100 and a corrugated coaxial cable connector 200 are illustrated. The corrugated coaxial cable 100 includes center conductor 105, dielectric 120, corrugated outer conductor 125 and jacket 130. Center conductor 105 is preferably annular and has an inside diameter 110 and outside diameter 115.

Corrugated coaxial cable connector 200 is preferable preassembled in a factory and includes a rear subassembly 202 and a front subassembly 204+The subassemblies 202, 204 are preferably attached to one another so that they can be shipped from the factory to the field as described in more detail below.

The rear subassembly 202 includes a rear outer body 206 having a front end 208, a backend 210, an external gripping portion 212 and a longitudinal opening 214 extending between the front end 208 and the back end 210 along the longitudinal axis A. The rear outer body 206 preferably includes a threaded portion 216 adjacent the front end 208 for threadingly engaging the front subassembly 204. Rear outer body 206 is preferably made from a metallic material such as brass and is preferable plated with a conductive, corrosion resistant material such as a nickel-tin alloy.

The rear subassembly 202 also includes a clamping member 220, which is preferably made from a plastic material such as acetal, but may be made from a metallic material such as brass and plated with a conductive, corrosion resistant material such as a nickel-tin alloy. Clamping member 220 is secured within the longitudinal opening 214 of rear outer body 206 by way of a free-rotating snap fit. Preferably, the clamping member 220 is secured in the rear outer body 206 in the factory. Clamping member 220 has a front end 222, a back end 224, and a longitudinal opening 226. At the front end 222, the clamping member 220 has a chamfered portion 228 leading to a first inwardly projecting protrusion 230 on the internal surface 232 of the longitudinal opening 226. A second inwardly projecting protrusion 234 is also present on the internal surface 232, disposed rearwardly from the first inwardly projecting protrusion 230. Preferably, the inwardly projecting protrusions 230, 234 are annular protrusions and extend around the longitudinal opening 226. However, they may also be segmented or non-continuous and still be within the scope of the present invention. As discussed in more detail below, the inwardly projecting protrusions 230, 234 engage the corrugated outer conductor 125 where the corrugated outer conductor 125 has the smallest diameter, i.e., the valleys of the corrugated outer conductor 125. The front end 222 of clamping member 220 preferably has a plurality of slots 240, resulting in the front end 222 having a plurality of fingers or flexible beams 242. The presence of the flexible beams allows the clamping member 220 to slide over the corrugated coaxial cable 100, and in particular, the corrugated outer conductor 125.

The front subassembly 204 includes front body 260, insulator 300, and contact element 320. The front body 260 has a front end 262, a back end 264, an external gripping portion 266, and a longitudinal opening 268 extending between the front end 262 and the back end 264 along the longitudinal axis A. The front body 260 also has a radiused annular shoulder 270 and internal threaded portion 272. As discussed in more detail below, the radiused annular shoulder 270 cooperates with the chamfered portion 228 of the clamping member 220 to capture the corrugated outer conductor 125 to secure the connector 200 to the coaxial cable 100. The internal threaded portion 272 cooperates with the threaded portion 216 of rear outer body 206 to secure the rear subassembly 202 and the front subassembly 204. Front body 260 is preferably made from a metallic material such as brass and is preferable plated with a conductive, corrosion resistant material such as a nickel-tin alloy. Insulator 300 includes a bore 302 aligned on longitudinal axis A and an outer surface 284. Insulator 300 is made from an electrically insulative material such as acetal and assists in centering and supporting contact element 320. Contact element 320 has a back end 322 that includes a tapered portion 324 that engages center conductor 105. Contact element 320 also preferably has a plurality of slots 326 at the back end 322 to allow the contact element 320 to flex as necessary to make physical and electrical contact with the central conductor 105. Contact element 320 is made from a metallic material such as beryllium copper, is preferably heat treated and is preferably plated with a conductive, corrosion resistant material such as a nickel-tin alloy. Contact element 320 has a front end 328 that has a female configuration to receive a male configured contact (not shown). However, the front end 328 of contact element 320 may also have a male configuration.

A plurality of seals, preferably in the form of O-rings, are also factory installed in the connector 200 to make it water proof. In the rear subassembly 206, seats 350, 360 and 370 have been installed as illustrated in FIG. 1. Seal 350 has been installed in an annular cut-out 352 at the back end 210 of the rear outer body 206. Seal 350 assists in making the connector 200 water-proof by engaging the jacket 130 of the coaxial cable 100 (see FIG. 3). Seal 360 is installed in an annular cut-out 362 in a medial portion of the rear outer body 206 and seals the junction between the clamping member 220 and the rear outer body 206. Seal 370 has been installed on the outer surface of the rear outer body 206 in an annular cut-out 372 and, as noted below in conjunction with FIG. 5, seals the junction of the rear outer body 206 and the front body 260 when the connector is assembled on the corrugated coaxial cable 100.

Two seals 380, 390 are also factory-installed in the front subassembly 204 to seal the connector 200 from the front. Seal 380 has been installed in an annular cut-out 382 on contact element 320 to seal the connector 200 when the contact element 320 is installed in insulator 300. Similarly, seal 390 is factory-installed in an annular cut-out 392 in insulator 300 to seal the junction between the insulator 300 and the front body 260.

Figure 3:
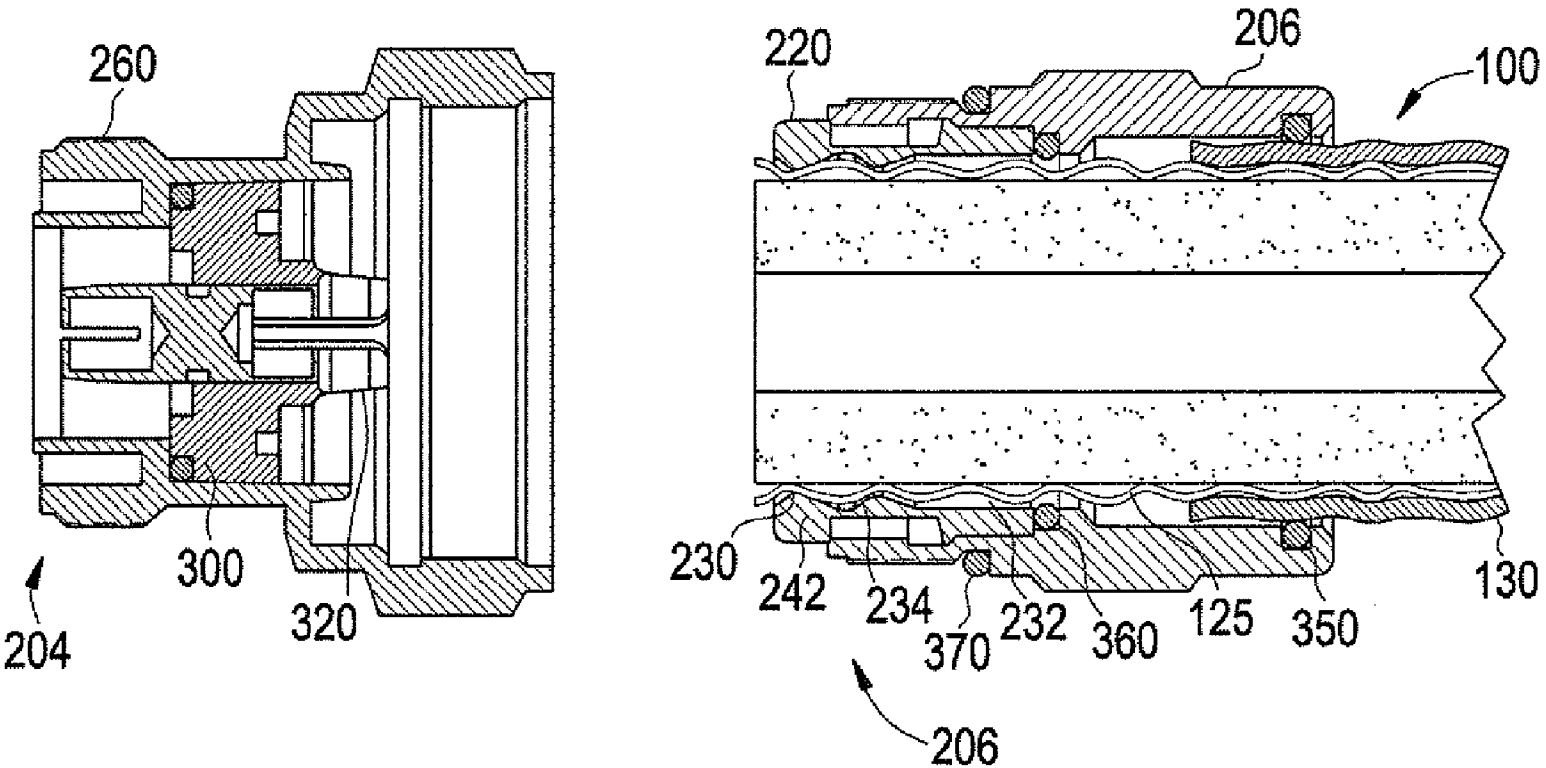
FIG. 3 is a cross-sectional view of the connector of FIG. 1 with a rear subassembly installed on the coaxial cable and the front subassembly prior to connection with the rear subassembly.

Turning now to FIG. 3, the installation of the corrugated coaxial cable connector 200 will now be described. If not already separated from one another, the rear subassembly 202 and front subassembly 204 should be separated from one another, i.e., unscrewed from one another in a preferred embodiment. The rear subassembly 202 is then placed over the corrugated coaxial cable 100, the corrugated coaxial cable 100 having the jacket 130 stripped back to expose a portion of the corrugated outer conductor 125. The clamping member 220 slides over the corrugated coaxial cable 100, and in particular, the corrugated outer conductor 125 with the plurality of fingers or flexible beams 242 flexing sufficiently to allow the rear subassembly 202 to slide on the corrugated coaxial cable 100. The rear subassembly 202 should naturally rest with the first inwardly projecting protrusion 230 on the internal surface 232 of the longitudinal opening 226 of clamping member 220 in an annular groove of the corrugated outer conductor 125. The second inwardly projecting protrusion 234 will also be in an annular groove of the corrugated outer conductor 125 and the seal 350 will engage the cable jacket 130.

Figure 4:
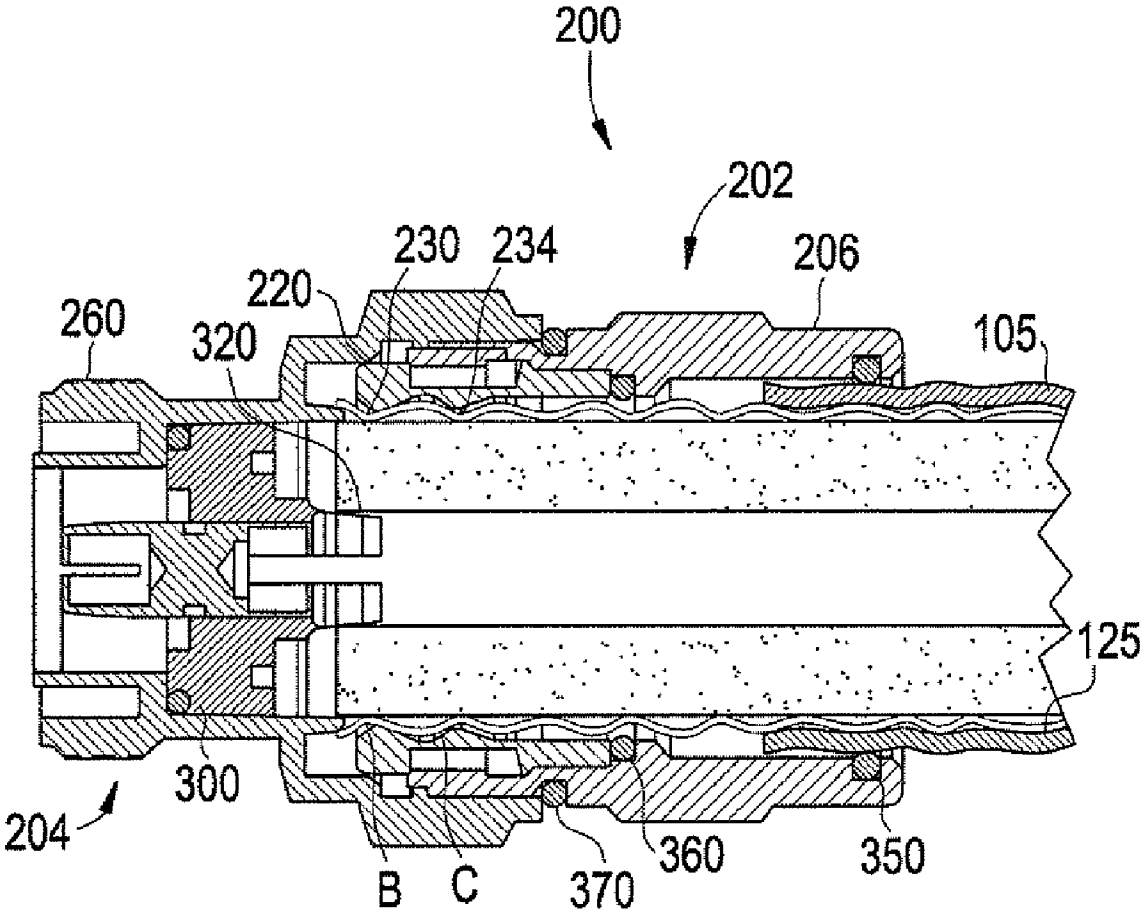
FIG. 4 is cross-sectional view of the connector of FIG. 1 with coaxial cable connector partially installed on the corrugated coaxial cable.

As illustrated in FIG. 4, the front subassembly 204 is partially installed on the rear subassembly 202, which in this embodiment is done by rotating the rear subassembly 202 and front subassembly 204 relative to one another. During the installation, the contact element 320 is aligned with and engages the inside diameter 110 of the center conductor 105. The tapered portion 324 assures that the contact element 320 will make physical and electrical contact with the center conductor 105. To the extent that the contact element 320 is larger than the inside diameter 110 of the center conductor 105, the slots 326 allow the contact element 320 to radially compress to fit within the center conductor 105. Simultaneously, the radiused annular shoulder 270 moves between the corrugated outer conductor 125 and the dielectric 120 to pinch the corrugated outer conductor 125 between the radiused annular shoulder 270 and the chamfered portion 228 of the clamping member 220.

Figure 5:
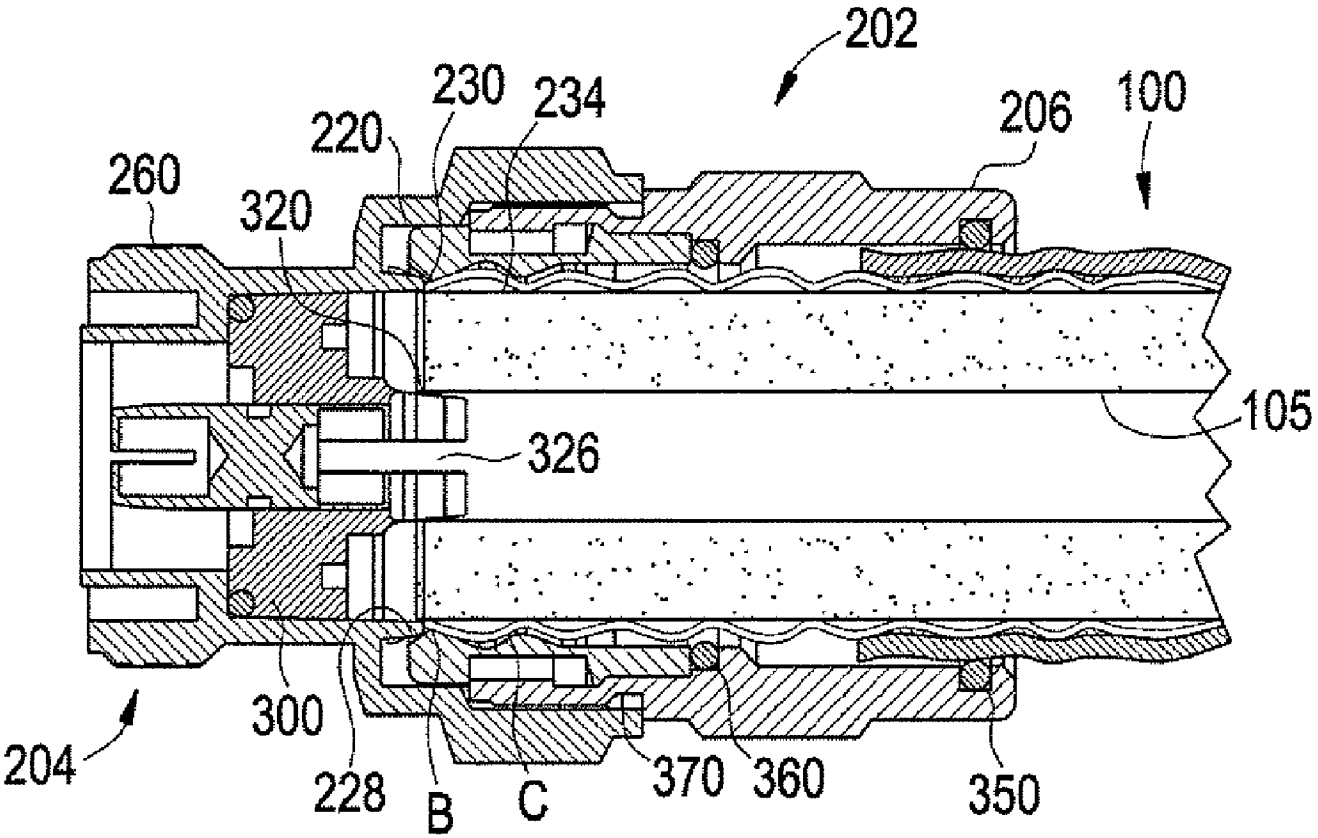
FIG. 5 is a cross-sectional view of the connector of FIG. 1 with coaxial cable connector fully installed on the corrugated coaxial cable.

In FIG. 5, the rear subassembly 202 is fully tightened into front subassembly 204 by further rotation of internal threaded portion 272 of front body 260 and external threaded portion 219 of rear body 206. It should be noted that the rotational engagement of front body 260 to rear body 206 does not transmit appreciable rotational or torsional load to clamping member 220 as it is a separate member (as well as a free rotating member), thus preventing damage to flexible beams 242 of clamping member 220. The first inwardly projecting protrusion 230 and second inwardly projecting protrusion 234 contact the corrugated outer conductor 125 at circumferential points B and C, respectively, and corrugated outer conductor 125 is captured between the radiused annular shoulder 270 and the chambered portion 228 of the clamping member 220 providing positive electrical and mechanical communication between corrugated outer conductor 125 and front body 260. Second inwardly projecting protrusion 234 contacts corrugated outer conductor 125 at circumferential point C and provides additional axial load as well as radial support thus further stabilizing the connector/cable junction. The additional radial support by the second inwardly projecting protrusion 234 is especially helpful to provide strain relief and ensure long term electrical and mechanical stability of the junction. Tertiary circumferential points of support for cable 100 are provided by seals 350 and 360, particularly since seal 360 is deformed inwardly by the connection of front body 260 to rear outer body 206.

Figure 6:
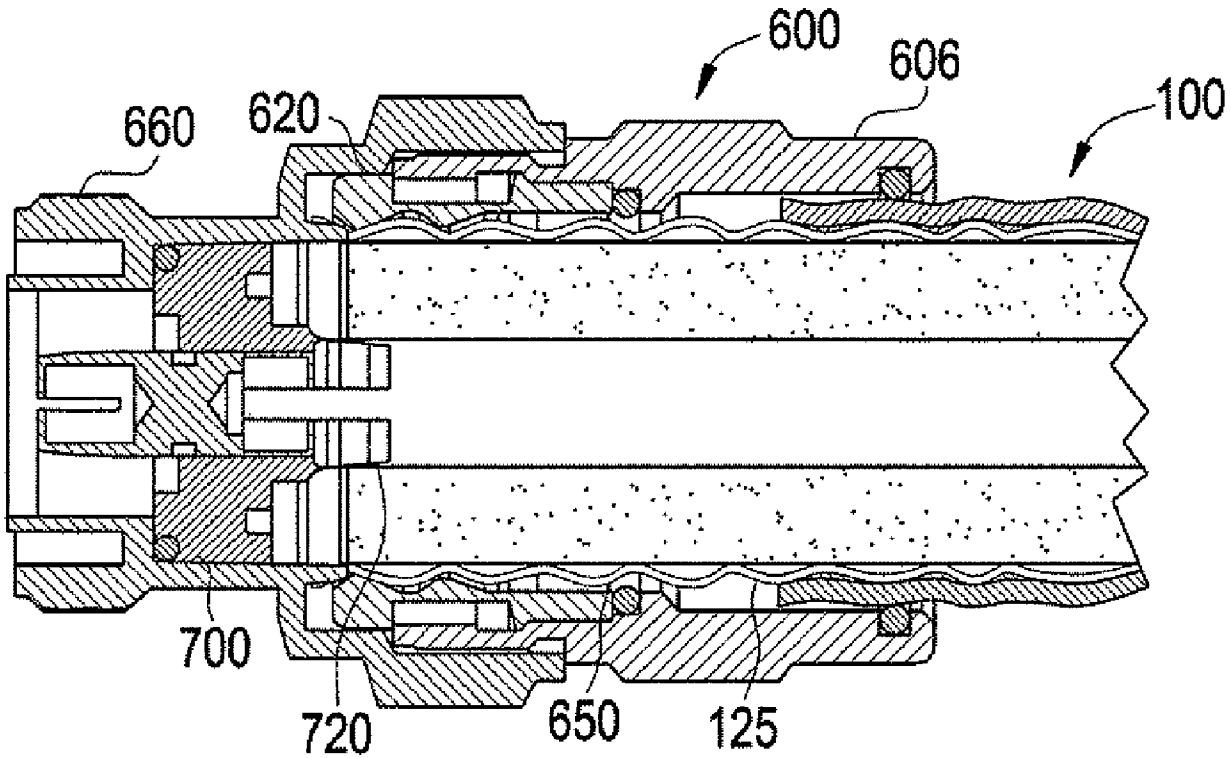
FIG. 6 is a view of another embodiment of a coaxial cable connector according to the present invention fully installed on a portion of a corrugated coaxial cable.

Another embodiment of a corrugated coaxial cable connector 600 according to the present invention is illustrated in FIG. 6. Corrugated coaxial cable connector 600 is similar to the first embodiment and has a rear outer body 606, a clamping member 620, a front body 660, insulator 700, and contact 720. The corrugated coaxial cable connector 600 also has the same seals, but clamping member 620 has an additional inwardly projecting annular projection 650 at the rear end thereof to engage the corrugated outer conductor 125 and provide a full 360 degree band of support for coaxial cable 100.

It will be apparent to those skilled in the art that various modifications and variations can be made to the present invention without departing from the spirit and scope of the invention. Thus it is intended that the present invention cover the modifications and variations of this invention provided they come within the scope of the appended claims and their equivalents.

What is claimed is:

1. A coaxial cable connector for attachment to a corrugated coaxial cable, the coaxial cable comprising a center conductor, a dielectric layer surrounding the center conductor, and an outer corrugated conductor surrounding the dielectric layer, the coaxial cable connector comprising:

a rear outer body having a front end, a back end, an external gripping portion, and a longitudinal opening extending between the front end and the back end along a longitudinal axis;

a clamping member rotatably mounted within the longitudinal opening in the rear outer body from the front end thereof, the clamping member having an internal surface with at least two projections configured to engage the outer corrugated conductor where the corrugated conductor has a diameter that is the smallest;

a front body having a front end, a back end, an external gripping portion, and a longitudinal opening extending between the front end and the back end along a longitudinal axis;

an insulator disposed in the front body, the insulator having an opening therein coaxial with the longitudinal axis of the front body; and a contact element disposed in the opening of the insulator, the contact element having a back end configured to engage the center conductor of the corrugated coaxial cable;

wherein the clamping member is secured within the longitudinal opening of the rear outer body by way of a free-rotating snap fit.

2. The coaxial cable connector according to claim 1, wherein the at least two projections comprise radially inward projecting annular rings.

3. The coaxial cable connector according to claim 1, wherein the at least two projections comprise three projections.

4. The coaxial cable connector according to claim 1, wherein the center conductor of the coaxial cable is hollow and has an interior surface and the contact assembly makes physical and electrical contact with the interior surface of the center conductor.

5. The coaxial cable connector according to claim 1, further comprising at least two seals configured to engage the corrugated coaxial cable when fully installed.

6. A combination of a corrugated coaxial cable and a coaxial connector, the coaxial cable comprising a center conductor, a dielectric layer surrounding the center conductor, an outer corrugated conductor surrounding the dielectric layer, and a jacket surrounding the outer corrugated conductor, the coaxial cable connector comprising:

a rear outer body having a front end, a back end, an external gripping portion, and a longitudinal opening extending between the front end and the back end along a longitudinal axis;

a clamping member rotatably mounted within the longitudinal opening in the rear outer body from the front end thereof, the clamping member having an internal surface with at least two projections engaging the outer corrugated conductor where the corrugated conductor has a diameter that is the smallest;

a front body having a front end, a back end, an external gripping portion, and a longitudinal opening extending between the front end and the back end along a longitudinal axis;

an insulator disposed in the front body, the insulator having an opening therein coaxial with the longitudinal axis of the front body; and a contact element disposed in the opening of the insulator, the contact element having a back end engaging at least a portion of the center conductor of the corrugated coaxial cable;

wherein the clamping member is secured within the longitudinal opening of the rear outer body by way of a free-rotating snap fit.

7. The coaxial cable connector according to claim 6, wherein the at least two projections comprise radially inward projecting annular rings.

8. The coaxial cable connector according to claim 6, wherein the at least two projections comprise three projections.

9. The coaxial cable connector according to claim 6, wherein the center conductor of the coaxial cable is hollow and has an interior surface and the contact assembly makes physical and electrical contact with the interior surface of the center conductor.

10. The coaxial cable connector according to claim 6, further comprising at least two seals engaging the corrugated coaxial cable when fully installed.

11. The coaxial cable connector according to claim 10, wherein at least one of the least two seals engages the jacket and at least one of the least two seals engages the outer corrugated conductor of the corrugated coaxial cable.

* * * * *